United States Patent [19]

Schimitzek et al.

[11] 4,392,331

[45] Jul. 12, 1983

[54] CLAMPABLE APPARATUS FOR GRINDING SPHERICAL SURFACES

[76] Inventors: Günter Schimitzek, An der Reute, 7923 Konigsbronn; Horst Reiche, Uhlandstr. 36, 7923 Konigsbronn, Zang, both of Fed. Rep. of Germany

[21] Appl. No.: 188,585

[22] Filed: Sep. 18, 1980

[30] Foreign Application Priority Data

Sep. 20, 1979 [DE] Fed. Rep. of Germany ..... 2937977

[51] Int. Cl.[3] ..... B24B 13/00

[52] U.S. Cl. ..... 51/55

[58] Field of Search ..... 51/55, 33 R, 284 R, 51/58, 105 EG, 105 LG, 106 LG, 124 L, 127, DIG. 15, 131.1, 134.5, 101 LG, 126, 96, 97 R, 160, 162; 125/15

[56] References Cited

U.S. PATENT DOCUMENTS

| | | | |
|---|---|---|---|
| 2,470,021 | 5/1949 | D'Avaucourt | 51/55 |
| 2,629,975 | 3/1953 | Desenberg | 51/55 |
| 3,117,396 | 1/1964 | Dalton | 51/33 R |
| 4,135,499 | 1/1979 | Schumacher | 125/15 |
| 4,216,626 | 8/1980 | Starp | 51/124 L |

*Primary Examiner*—James G. Smith
*Assistant Examiner*—Robert A. Rose

[57] ABSTRACT

Clampable apparatus for producing convex and/or concave spherical surfaces such as optical lenses, comprising a frame, a swivel arm in the form of a gantry and mounted on the frame such that its angle of inclination relative thereto is adjustable, the swivel arm including two spaced apart support portions, a rocker arm pivotally and adjustably mounted on an axle extending between the support portions, the rocker arm having a spindle sleeve housing axially displaceably mounted thereon, the housing receiving a rotatably mounted tool spindle carrying a machine tool, a workpiece spindle supporting a workpiece being rotatably provided at the frame, the tool and workpiece being locatable in the plane of the tool spindle axis of rotation, the rocker arm and swivel arm being selectively adjustably locatable and securable in a desired position, and a pair of clamping devices, wherein such arms are retained in such position by the clamping devices, and such clamping devices are substantially identical and symmetrically disposed relative to the tool spindle axis of rotation and in turn to such plane so as to be substantially mirror-images of one another, each clamping device comprising two cooperating members which are braceable or tensionable, i.e. clampingly embraceable, by frictional engagement with one another, one member being mounted on the swivel arm and the other member being mounted on the rocker arm, whereby to prevent lateral deviation of the rocker arm and in turn of the tool spindle axis of rotation from such plane.

17 Claims, 5 Drawing Figures

CLAMPABLE APPARATUS FOR GRINDING SPHERICAL SURFACES

Figure 1:
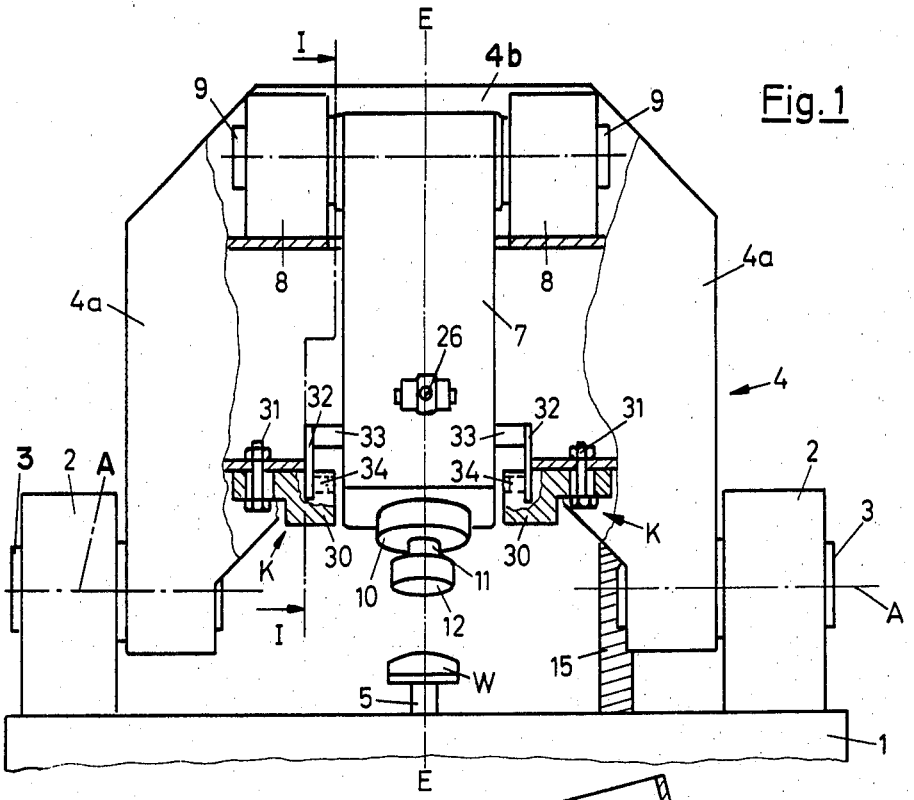

The present invention relates to a clampable apparatus for producing convex and/or concave spherical surfaces, such as optical lenses, and more particularly to such an apparatus for precise clamping under operating conditions.

A known apparatus for producing such spherical surfaces comprises a swivel arm mounted on the frame of the apparatus such that the angle of inclination of such arm is adjustable and the arm itself is in the form of a gantry. The known apparatus further comprises a rocker arm pivotally mounted on an axle between the support portions of the gantry in such a manner as to be adjustable and such that the rocker arm guides an axially displaceable spindle sleeve housing which, in turn, has a spindle carrying a machine tool, such as a cup-grinding wheel, rotatably mounted thereon. The usual spindle supporting the workpiece to be subjected to grinding is located in the pivotal plane of the gantry.

It is also known that by using a cup-grinding wheel driven by a tool spindle located on a swivel arm such as in an apparatus of the stated type, a polishable cross-grind, i.e. appropriate material removal, is obtainable which has a suitable peak-to-valley height to provide a precise spherical shape in the workpiece for a subsequent polishing operation. However, in the production of a spherical surface for optical lenses, this can only be achieved if the axes of the machine tool and workpiece spindles are both located accurately in the pivotal plane for the tool spindle. Of lesser importance is the angle of inclination which the tool spindle subtends with the workpiece spindle as this merely affects the radius of the spherical surface.

It is important that the workpiece spindle in such known apparatus be controlled to maintain an accurate relative position to the tool spindle while material is being removed by the grinding operation, and that such relative positioning be unaffected by mechanical or thermal factors. To prevent the work tool spindle from being laterally displaced from its set position during such grinding operation, tensioning or clamping devices are already known which are mounted on the frame side of the apparatus so as to act on the tool spindle holder and thereby to retain it.

The use of such conventional devices and the experience gained therefrom have, however, shown that the different temperatures occurring during the grinding operation of the machine cause thermal stresses to be set up. This has been proved to be the cause of undesired displacement of the tool spindle axis, albeit slight, with consequential detriment to the workpiece being treated.

It is among the objects and advantages of the present invention to overcome the above noted deficies and disadvantages of the prior art and to provide a clampable apparatus for producing polishable spherical surfaces in workpieces such as optical lenses in which precise clamping under operating conditions is made possible.

It is among the additional objects and advantages of the present invention to provide an apparatus generally of the foregoing type in which temperature fluctuations or deviations from the normal operating temperature during the grinding operation are substantially prevented from having an adverse effect on the bracing or spatial positioning of the rocker arm supporting the tool spindle, and thereby displacement of the tool spindle from its desired position in a common plane with the workpiece spindle is correspondingly prevented as well.

Figure 2:
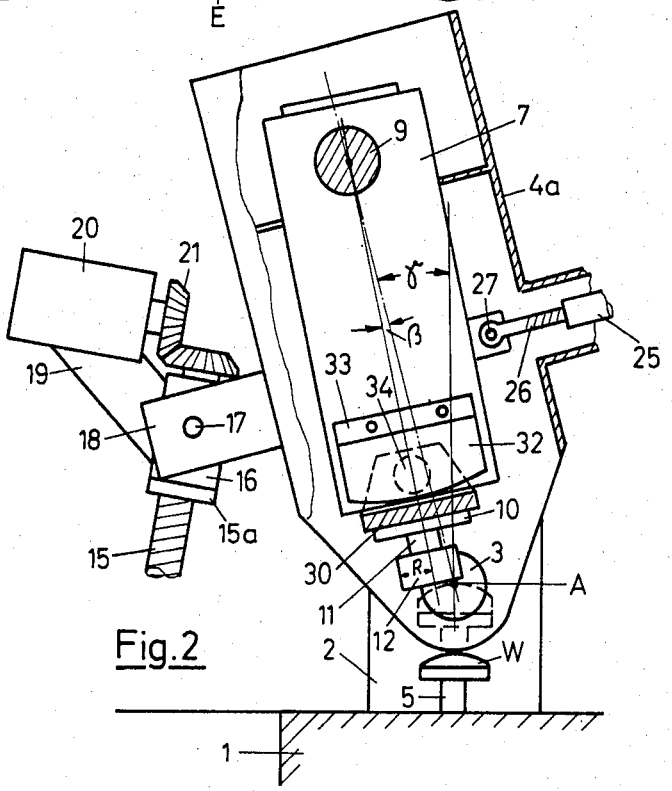
Figure 3A:
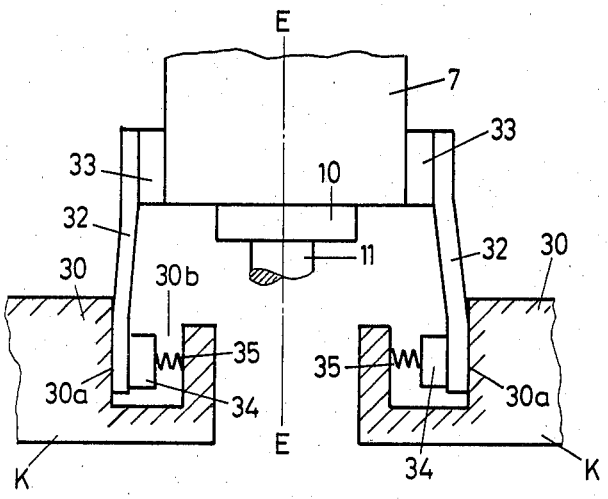
Figure 3B:
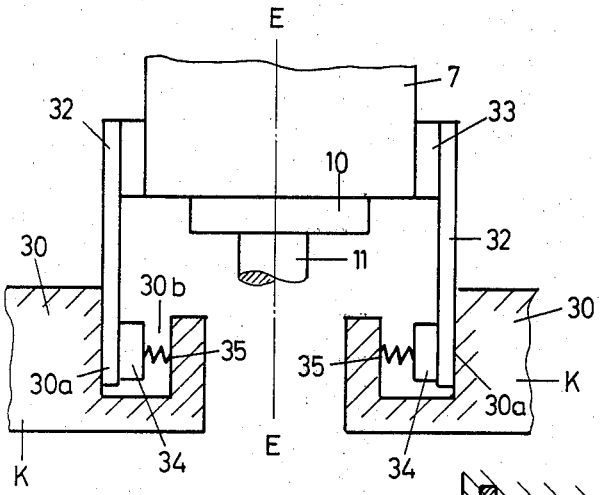
Figure 4:
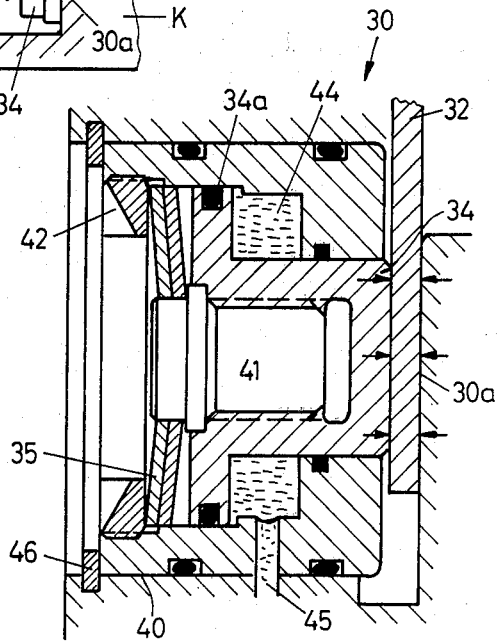

Other and further objects and advantages of the present invention will become apparent from a study of the within specification and accompanying drawings, in which:

FIG. 1 shows a schematic front elevation of an apparatus in accordance with an embodiment of the present invention, FIG. 2 shows a schematic side view, partially in section, of the apparatus taken along the line I—I of FIG. 1, FIGS. 3*a* and 3*b* are schematic views which show, respectively, different operational positions of clamping components of the apparatus shown in FIGS. 1 and 2, and FIG. 4 is a schematic view corresponding to the system of FIGS. 3*a* and 3*b* and which more particularly shows one embodiment of a clamping cup forming part of the apparatus shown in FIGS. 1 and 2.

According to the present invention, a clampable apparatus for producing convex and/or concave spherical surfaces such as optical lenses is provided. The apparatus generally comprises a frame, a swivel arm in the form of a gantry and mounted on the frame such that its angle of inclination relative to the frame is adjustable, the swivel arm including two spaced apart support portions, and a rocker arm pivotally and adjustably mounted on an axle extending between the support portions. The rocker arm has a spindle sleeve housing axially displaceably mounted thereon, the housing receiving a rotatably mounted spindle carrying a tool.

Also, a spindle supporting a workpiece is provided, such that the tool and workpiece are selectively located in the plane of the axis of rotation of the tool spindle. The rocker arm and the swivel arm advantageously are adjustably locatable and securable in a desired position, and said arms are in turn retained in the desired position by clamping devices.

The clamping devices are substantially identical and symmetrically disposed relative to the axis of rotation of the tool spindle so as to be substantially mirror-images of one another. Each clamping device comprises two cooperating members which are braceable or tensionable by frictional engagement with one another, one member being mounted on the swivel arm and the other member being mounted on the rocker arm.

Advantageously, such arrangement permits substantially full compensation of temperature-caused undesired forces such as those due to thermal expansion which cause a displacement of the tool spindle from its proper location in a common plane with the workpiece spindle. The significance of this inherently symmetrical compensation will be readily apparent upon appreciating that temperature differences of only a few degrees have been observed in machines of the type in question for processing spherical surfaced lenses and that such temperature differences are not regarded as negligible. These temperature differences in fact cause significant changes in shape in the various operating parts of the apparatus depending on the coefficients of thermal expansion of the materials used and can, therefore, cause stresses to be set up.

The present invention, however, provides symmetrical compensation which, independently of the prevailing operating temperature, permits full compensation during the bracing or deformation of the rocker arm to be achieved.

To permit mutual adjustment of the components of the two clamping devices to be effected with minimal structural and time expenditure, it is desirable that at least one of the two cooperating members be adjustable relative to the other member and be securable in a desired selective adjusted position. To adjust the clamping devices, therefore, it is only necessary to warm up the apparatus to the normal operating temperature and then to adjust the adjustable portion relative to the fixed part and then retain it in the desired position. It is thereafter merely necessary to insure that the components of the clamping devices, which complement, i.e. symmetrically, one another with regard to their effect, assume a relative mutual position in which the part of each clamping device to be braced is not subjected to any significant change of shape.

Preferably, one of said cooperating members comprises a tension block adjustably mounted on the support portion of the swivel arm, a clamping cup exerting a tensional effect being located in said block, and the other of said cooperating members comprises a clamping rail located on one side of the rocker arm which cooperates with the clamping cup, the bracing of the rail relative to the tension block being effected by means of a tensional force emanating from the clamping cup.

To prevent breakdowns of the clamping device, it is desirable that spring means be provided for bracing of the clamping rail by the clamping cup, and that hydraulic, pneumatic or electromagnetic pressure means or the like be provided for counteracting the spring force and annulling or cancelling the corresponding spring bracing force.

Preferably, the tension block and clamping cup located in such tension block comprise an arrangement including a pressure cylinder and a pressure or thrust piston biased by at least one plate spring, said pressure piston being actuatable hydraulically, pneumatically or electromagnetically or by like means so as to counteract the biasing action of the plate spring, the pressure or thrust piston being provided with a pressure or thrust surface protruding from one end of the pressure cylinder for clamping contact with the clamping rail thereat.

Further, preferably, the clamping rails are made of a resilient metal such as spring steel.

Referring to the drawings, an apparatus is shown for producing spherical surfaces in workpieces such as optical lenses by machine grinding, which comprises a basic frame 1 having two pedestal bearings 2 disposed thereon on which a swivel arm 4 is pivotally mounted by means of corresponding journals 3 and mutually supported bevelled roller bearings in the usual manner.

The swivel arm 4 is suitably in the form of a gantry and hence is extremely stable, as the artisan will appreciate. The swivel arm 4 or gantry is supported by means of a gantry adjustment device described in greater detail hereinafter and is selectively adjustable about its pivotal axis A with regard to its angle of inclination $\gamma$ (gamma) relative to the frame 1 (see FIG. 2).

Also mounted for rotation on the frame 1 is a workpiece spindle 5 which supports a workpiece W such as an optical lens to be machine ground. The rotatable workpiece spindle 5 is driven mechanically and is selectively adjustable vertically relative to the frame 1 in the usual way.

The swivel arm 4 suitably comprises two laterally spaced apart support members or support portions 4*a* conveniently in the form of a housing and a cross-member 4*b* interconnecting the support members or portions 4*a* in the form of an inverted U-shaped structure or gantry. An axle 9 having its ends pivotally received in braced bevel roller bearings 8 is inserted into the cross-member 4*b*.

A rocker arm 7 is downwardly suspended from the axle 9 and is adjustable by means of a rocker arm adjustment device also described in detail hereinafter. The rocker arm 7 is selectively adjustable so as to subtend a predetermined angle $\beta$ (beta) relative to the swivel arm 4 (see FIG. 2). To insure the necessary stability and freedom from vibration, the rocker arm 7 is conveniently formed as a block type structure.

A spindle sleeve housing 10 is mounted in the rocker arm 7, the housing being selectively longitudinally displaceable in conventional manner. A mechanically driven tool spindle 11 is rotatably mounted in suitable manner in the axially displaceable housing 10. On the free end of the tool spindle 11, a machine tool 12, such as a diamond-cup grinding wheel, of the type conventially used to produce spherical surfaces, is mounted so as to rotate with the spindle 11.

As shown in FIG. 2, a threaded adjustment spindle 15, preferably in the form of a conventional rotary ball spindle, is provided for supporting the swivel arm 4 relative to the frame 1 and for selectively adjusting the angle of inclination $\gamma$ commensurate with the radius of the spherical surface of the workpiece W to be treated, as the artisan will appreciate. The lower end of the spindle 15 engages in a nut (not shown) pivotally mounted on the frame 1. At its end nearer the swivel arm 4, the spindle 15 has a cylindrical collar portion 15*a* on which a guide bush 16 abuts through the intermediary of an axial thrust bearing. The guide bush 16 provides additional guidance for the threaded spindle 15. This guide bush 16 is, in turn, provided with laterally extending hinge pins 17 which engage in receiving bores machined into straps 18 stationarily secured to the swivel arm 4.

For driving the threaded spindle 15, which is axially secured relative to the guide bush 16, an electrical stepping or stepped motor 20 is used in the usual way. This is stationarily secured to the guide bush 16 by means of a support 19, the motor 20 being arranged in driving engagement with the threaded spindle 15 through a bevel gearing 21, 22. A control device (not shown) which is actuated by one or more pushbuttons is provided for causing the electric motor 20 to execute either continuous or stepped rotary movement in one or the other direction of rotation.

When the motor 20 is so actuated, the swivel arm 4 executes a pivotal movement about the axis A in the appropriate direction and hence increases or reduces its angle of inclination $\gamma$, dependent upon the number of spindle rotations or stepping sequences, as the artisan will appreciate. When the spindle 15 rotation is completed, the swivel arm 4 is automatically maintained in the setting position thus attained.

For the purpose of adjusting the rocker arm 7 to the desired setting angle $\beta$ corresponding to the diameter of the cup wheel 12 being employed, a rocker arm drive is provided having a powered self-locking effect. The latter comprises an electric motor (not shown) which is preferably a stepping or stepped motor and which is in driving engagement with a spindle nut 25. The spindle nut 25 is engaged by a threaded rod 26 which is hingedly connected to one end of the rocker arm 7 by means of a pair of journals 27.

By means of a control device (not shown) the motor may be caused to effect continuous or stepped rotary movements in one or the other direction of rotation, resulting in the reduction or extension in the effective length of the adjustment member or composite linkage 25, 26. This change in effective length also changes the size of the angle $\beta$ so that the tool diameter or effective diameter of the cutting lip of the tool 12 can be taken into account. Depending upon the direction of rotation of the motor shaft, this results in a reduction or an increase in the size of the angle $\beta$, as the artisan will appreciate.

As thus stated, the range of adjustment of the rocker arm 7 takes into account the diameter of the cup wheel 12 being used. As will be appreciated, the cutting lip of the cup wheel 12 must be level with the axis A so as to engage accurately with the apex of the spherical surface to be produced on the workpiece W (see FIG. 2). To insure this, the workpiece spindle 5 must be vertically adjustable and the tool spindle 11 and workpiece spindle 5, as can be clearly seen in FIG. 1, must be located accurately in the same plane E—E, the plane E—E simultaneously being the pivotal plane for the rocker arm 7 on the axle 9 and thus may be termed the plane in which the tool spindle axis of rotation is to be situated. Only when these conditions are attained is it possible to achieve a so-called cross-grind or polish during the production of a lens having a spherical surface.

By "cross-grind or polish" is generally understood the state of a surface machining in which the characteristic feature is a plurality of semi-circular grinding grooves, all of which intersect at the apex of the spherical surface of the workpiece being treated and radiate therefrom in different directions, such grooves being caused by the engagement of the rotating cutting lip of the machine tool 12 on the rotating workpiece W.

To enable a surface with such a cross-ground section to be produced, the locating of the rocker arm 7 which is suspended relative to the workpiece spindle 5 in its selectively pre-set position, cannot be accurately achieved solely by means of the bearings 8 and the axle 9, as the artisan will appreciate. It is also necessary to insure that the free end of the rocker arm 7 is reliably maintained in the plane E—E. Finally, it is necessary to insure that the forces which occur while the machine is inherently heating up from ambient temperature to its operating temperature, such as those factors set up by thermal expansion of the material, cannot lead to displacement of the tool spindle 11, and hence of the tool 12, from its spatial location in the mutual or common plane E—E with the workpiece spindle 5.

To prevent this undesired displacement, that is to say, to prevent the rocker arm 7 from being affected by secondary forces acting transversely to the pivotal plane E—E, two substantially identical clamping devices K (see FIG. 3*a*) are provided, one on each side of the rocker arm 7, which are symmetrically bilaterally disposed relative to the pivotal plane E—E. The two opposed clamping devices K have a structural configuration such that unavoidable expansion forces, such as those which are traceable to the cold state of the machine before it is put into operation, can have an effect.

When the machine is warmed up, with the constituent parts thereof heated to their operating temperature, mutually braced components of the opposed clamping devices K move into an operational position as shown in FIG. 3*b*. This change in shape can be predicted in the cold state of the machine and is caused by the thermal expansion of the rocker arm 7, whereby a calibrating setting of the rocker arm 7 completely free from the effect of secondary forces can be achieved.

As shown in FIGS. 3*a* and 3*b*, each of the two clamping devices K comprises a tension block 30 having a tension or pressure surface 30*a*. The tension block 30 is selectively adjustably mounted on a support portion 4*a* for the swivel arm 4. The disengageable selectively adjustable connection of the tension block 30 with the support portion 4*a*, schematically shown at 40 (see FIGS. 3*a* and 3*b*, and 4), is effected by means of screws 31 or any other suitable securing means (see FIG. 1).

A slot 30*b* extending parallel to the pivotal plane E—E is machined into each block 30 in which, as shown in FIGS. 1 and 2, a corresponding clamping rail 32 engages. This latter clamping rail or member 32, in turn, is secured by means of a spacer element 33 to the respective lateral side of the body or block structure of rocker arm 7. In the region of the tension block 30 in which the clamping rail 32 is located, a clamping cup or member 34 is provided. This cup 34, as shown schematically in FIGS. 3*a* and 3*b*comprises a thrust member 34 which is biased by a compression spring schematically shown at 35. This spring biased cup 34 presses the clamping rail 32 against the pressure surface 30*a* of the tension block 30.

A comparison of FIGS. 3*a* and 3*b* shows that the cooperation of the tension block 30 with the clamping rail 32 is such that, in a cold state of the machine (FIG. 3*a*), such as at room temperature, bracing or tensioning of the clamping rail 32 must be accompanied by simultaneous deformation there of in lateral or outward direction relative to the pivot plane E—E. In the cold state of the machine, such changes of shape and the development of bracing or tensioning forces occurring therewith can be permitted without adverse effects, as the artisan will appreciate.

On the other hand, this is not true when the machine is ready for, or has been used. For this reason, the association of the clamping devices K with the clamping rail 32 is such as to take the inherent corresponding thermal expansion into account. Accordingly, once the machine has warmed up, that is to say, when it is desired to attain accurate relative positioning of tool spindle 11 and the workpiece spindle 5, the clamping devices K and the rails 32 cooperate so that the rocker arm 7 is retained in a manner free from secondary forces.

To achieve this effect, and to determine the calibrating setting position of the tension block 30, the procedure is preferably such that, firstly, the machine is allowed to warm up so the rocker arm 7 assumes the operating temperature, and after this has been achieved, then, the still released tension block 30 is adjusted until its pressure surface 30*a* abuts against the clamping rail 32 (see FIG. 3*b*). The tension block 30 is thereafter finally securely connected to the swivel arm 4 by means of a securing screw or screws 31 or the like.

FIG. 4 shows one embodiment of a specific type of clamping cup, the clamping rail 32 and pressure application surface 30*a* also being shown schematically. The clamping cup arrangement comprises a cylindrical housing 40 portion of tension block 30 in which a thrust member 34 as clamping cup and simultaneously acting as a piston is located in an axially displaceable manner. A centering journal or pin 41 is arranged in each thrust member or piston 34, preferably so as to be concentric therewith. On each journal or pin 41 are mounted one or more biasing plate springs 35. The plate springs 35 abut centrally against the corresponding journal or pin 41 and also abut peripherally against a corresponding end ring 42 which is screw-threaded into the adjacent housing 40 of the tension block 30 thereat. The thrust member 34 is thus subjected to a constant axial pressure or biasing spring pressure of a high tensional force.

The free end face of each thrust member or piston 34 protrudes slightly from the housing 40 and in turn transmits such high tensional force of the biasing springs 35 on the corresponding clamping rail 32 so as to cause the clamping rail to be pressed against the adjacent pressure application surface 30*a* of the tension block 30 thereat and be maintained thereby in the bracing or tensioning pressure application position or clampingly embracing position by frictional engagement. To permit the thrust member or piston 34 to be moved axially in reverse direction against the force of the biasing plate springs 35, that is to say, to enable the tensioning of the clamping rail 32 to be removed or released, an annular flange portion 34*a* is provided on the thrust member 34.

This flange portion 34*a*, together with the corresponding cavity of the adjacent cylindrical housing 40, forms a ring chamber or coacting cylinder 44. The chamber or cylinder 44 may be supplied with a pressure fluid medium for operating the thrust member or piston 34 against the biasing force of the springs 35, through a control valve (not shown) and a radial bore 45 in housing 40.

The pressure fluid medium thus exerts a pressure on the thrust member or piston 34 in a direction opposite to the pressure applied by the plate springs 35. As the artisan will appreciate, such pressure fluid medium pressure is independent of the function of the control valve therefor (not shown) for as long as the pressure fluid, e.g. liquid, is permitted to escape through the radial bore 45. The desired fixed axial location of the clamping cup, as can also be seen in FIG. 4, is insured by providing a ring spring or retainer 46 insertable into a ring groove provided in the tension block 30. Such ring spring 46 also forms a reinforcing block for the axial forces acting in the clamping cup.

Thus, according to the present invention a clampable apparatus is advantageously provided for producing convex and/or concave spherical surfaces in workpieces such as optical lenses, generally comprising a frame, a swivel arm substantially in the form of a gantry and mounted on the frame such that its angle of inclination relative thereto is adjustable, the swivel arm including two support portions having an axle extending therebetween, a rocker arm pivotally and adjustably mounted on the axle, the swivel arm and rocker arm being adjustably locatable and securable in a selective adjustment position, a spindle sleeve housing axially displaceably mounted on the rocker arm and having a tool spindle for carrying a machine tool to machine a workpiece and being received in the housing and mounted for rotation about a tool spindle axis of rotation lying in a tool spindle plane in any adjustment position of the swivel arm and rocker arm, a workpiece spindle for supporting a workpiece to be machined by the machine tool and being arranged at the frame such that the machine tool and workpiece are locatable in the plane of the axis of rotation of the tool spindle, and a pair of clamping devices for retaining the swivel arm and rocker arm in any such adjustment position.

The clamping devices significantly are preferably substantially identical and symmetrically disposed relative to the axis of rotation of the tool spindle so as to be substantially mirror images of one another, each clamping device having two cooperating members which are clampingly embraceable, preferably by frictional engagement, with one another, one such member being correspondingly mounted on the swivel arm and the other such member being correspondingly mounted on the rocker arm, whereby to prevent lateral deviation of the rocker arm and in turn of the tool spindle axis of rotation from the tool spindle plane.

Desirably, at least one of the two cooperating members of each clamping device is adjustable relative to the other corresponding member and is securable in a selective adjusted clamping position, e.g. consonant with the operating temperature state of the appropriate parts of the apparatus.

More specifically, one of the cooperating members includes a tension block adjustably mounted on a corresponding supporting portion of the swivel arm and which has a clamping cup for exerting a tensional force located in such tensional block, and the other of the cooperating members includes a clamping rail located on a corresponding lateral side of the rocker arm which cooperates with the clamping cup, such that the clamping rail is clampingly embraced relative to the tension block by the tensional force exerted by the clamping cup.

Spring means capable of exerting a tensional spring force are advantageously provided for clampingly embracing the clamping rail by the clamping cup, and counteracting pressure release means are similarly provided for counteracting the spring force so as to release the clamping embracing of the clamping rail by the clamping cup.

More particularly, the tension block includes a pressure cylinder and the clamping cup includes a thrust piston biased by at least one tension spring force exerting plate spring and having a thrust surface protruding from an end of the pressure cylinder for clampingly embracing the clamping rail thereat, the thrust piston being actuatable by the pressure release means so as to counteract the biasing spring force of the plate spring. Preferably, the counteracting pressure release means includes pressure fluid means in the pressure cylinder for actuating the thrust piston, e.g. hydraulic or pneumatic pressure fluid means, although electromagnetic or electromechanical counteracting pressure release means or the like may also alternatively be used for such purposes, if desired.

Significantly, because of the need to accommodate structural and thermal stresses and forces in the apparatus in the transition from the cold state to the heated up or operating state thereof, the clamping rails are preferably made of a resilient metal such as spring steel. The tool spindle may be suitably provided with a machine tool such as one in the form of a cup grinding wheel.

In accordance with a further aspect of the arrangement of the present invention, the clampable apparatus for producing convex and/or concave spherical surfaces in workpieces such as optical lenses, may advantageously comprise a frame, a swivel arm adjustably mounted on the frame for movement to a selective adjustment position relative to the frame, a rocker arm adjustably mounted on the swivel arm for movement to a selective adjustment position relative to the swivel arm, a tool spindle for carrying a machine tool to machine a workpiece, and which is mounted on the rocker arm for axial displacement relative thereto and for rotation about a tool spindle axis of rotation lying in a tool spindle plane, a workpiece spindle for supporting a workpiece to be machined by the machine tool, and which is arranged at the frame in the tool spindle plane, mounting means for maintaining the tool spindle axis of rotation in the tool spindle plane in any selective adjustment position of the swivel arm and of the rocker arm and in turn of the tool spindle and for locating the machine tool and workpiece in such plane, and bilateral clamping means on opposed sides of the tool spindle plane for releasably retaining the swivel arm and rocker arm in any selective adjustment position relative to each other.

The bilateral clamping means may favorably include a pair of correspondingly opposed clamping devices substantially symmetrically disposed relative to the axis of rotation of the tool spindle, each clamping device having two cooperating members which are clampingly embraceable by operative engagement with one another, one such member being correspondingly mounted on the swivel arm and the other such member being correspondingly mounted on the rocker arm, whereby to prevent lateral deviation of the rocker arm and in turn of the tool spindle axis of rotation from the tool spindle plane.

More specifically, the clamping devices may desirably be substantially identical and symmetrically disposed so as to be substantially mirror images of one another. Preferably, at least one of the two cooperating members of each clamping device is adjustable relative to the other corresponding member and is securable in a selective adjusted clamping position, whereby to calibrate and accommodate advantageously mechanical and thermal stresses of the associated parts of the apparatus traceable to deviation of such parts from desired precise spatial positioning thereof during transition between the cold state (see FIG. 3*a*) and the warm or operating state (see FIG. 3*b*) of the overall apparatus.

Desirably, one of the cooperating members may include a tension block adjustably mounted on a corresponding supporting portion of the swivel arm and which has a clamping cup for exerting a biasing tensional force located therein, and the other of the cooperating members may include a clamping rail, preferably made of a resilient metal such as spring steel, located on a corresponding lateral side of the rocker arm which cooperates with the clamping cup, such clamping rail suitably being clampingly frictionally embraced relative to the tension block by the tensional force exerted by the clamping cup.

Spring means capable of exerting a biasing tensional spring force may be favorably provided for clampingly embracing the clamping rail by the clamping cup, and counteracting pressure release means may be likewise provided for counteracting the spring force to release the clamping embracing of the clamping rail by the clamping cup. More specifically, the tension block may desirably include a pressure cylinder and the clamping cup may similarly include a thrust piston biased by at least one tension spring force exerting plate spring and which has a thrust surface operatively protruding from the pressure cylinder for clampingly embracing the clamping rail thereat. Moreover, the pressure release means may include pressure fluid means in the pressure cylinder, e.g. in the form of hydraulic or pneumatic pressure fluid medium, such that the thrust piston is actuatable thereby for counteracting or counterbalancing the biasing force of the plate spring.

It will thus be seen that an arrangement of the various operating parts of the apparatus is provided according to the present invention in which precise clamping under operating conditions is made possible, and in which temperature fluctuations or deviations from the normal operating temperature during the workpiece grinding operation are substantially inherently prevented from having an adverse effect on the bracing or spatial positioning of the rocker arm supporting the tool spindle. Consequently, displacement, e.g. laterally, of the tool spindle from its desired position of alignment in a common plane with the workpiece spindle is correspondingly prevented as well. This is directly due to the presence of the bilateral clamping means which operatively releasably bracingly interconnect by clamping engagement the swivel arm and the rocker arm on both lateral sides of the rocker arm to prevent lateral deviation of the rocker arm and in turn of the tool spindle from its normal position of alignment in a common plane with the workpiece spindle during the contemplated grinding operation.

Further general features of common construction and operation of an apparatus of the instant type, apart from the instant bilateral clamping means system and arrangement, may be appreciated from the cognate disclosure in applicants' corresponding application simultaneously filed herewith for APPARATUS FOR PRODUCING CONVEX AND/OR CONCAVE SPHERICAL SURFACES SUCH AS OPTICAL LENSES, i.e. Ser. No. 188,372 filed Sept. 18, 1980.

It will be appreciated that the foregoing specification and accompanying drawings are set forth by way of illustration and not limitation of the present invention, and that various modifications and changes may be made therein without departing from the spirit and scope of the present invention which is to be limited solely by the scope of the appended claims.

What is claimed is:

1. Clampable apparatus operable at a heated operating temperature for producing convex and/or concave spherical surfaces in workpieces such as optical lenses, comprising a frame, a swivel arm substantially in the form of a gantry and mounted on the frame such that its angle of inclination relative thereto is adjustable, the swivel arm including two support portions having an axle extending therebetween, a rocker arm pivotally and adjustably mounted on the axle, the swivel arm and rocker arm being adjustably locatable and securable in a selective adjustment position, a spindle sleeve housing axially displaceably mounted on the rocker arm and having a tool spindle for carrying a machine tool and being received in the housing and mounted for rotation about a tool spindle axis of rotation lying in a tool spindle plane, which plane is normal to the axle, in any adjustment position of the swivel arm and rocker arm, a workpiece spindle for supporting a workpiece to be machined by the machine tool and being arranged at the frame such that the machine tool and workpiece are locatable in the plane of the axis of rotation of the tool spindle, and a pair of clamping devices for retaining the swivel arm and rocker arm in any such adjustment position, said clamping devices being substantially identical and symmetrically disposed relative to the axis of rotation of the tool spindle so as to be substantially mirror images of one another, each clamping device having two cooperating members which are clampingly embraceable by frictional engagement with one another, one such member being mounted on the swivel arm and the other such member being mounted on the rocker arm, one of the members of each clamping device being arranged for operative displacement to a heated operating temperature displacement location relative to the arm on which it is mounted, when the apparatus is at its corresponding heated operating temperature, for operative engagement at such displacement location with the other member of such clamping device, whereby to prevent lateral deviation of the rocker arm and in turn of the tool spindle axis of rotation from the tool spindle plane.

2. Apparatus according to claim 1 wherein at least one of the two cooperating members of each clamping device is selectively independently adjustable relative to the arm on which it is mounted and to the other corresponding member and is securable in a selectively independently adjusted clamping position for frictional engagement at such position with the other corresponding member.

3. Clampable apparatus for producing convex and/or concave spherical surfaces in workpieces such as optical lenses, comprising a frame, a swivel arm substantially in the form of a gantry and mounted on the frame such that its angle of inclination relative thereto is adjustable, the swivel arm including two support portions having an axle extending therebetween, a rocker arm pivotally and adjustably mounted on the axle, the swivel arm and rocker arm being adjustably locatable and securable in a selective adjustment position, a spindle sleeve housing axially displaceably mounted on the rocker arm and having a tool spindle for carrying a machine tool and being received in the housing and mounted for rotation about a tool spindle axis of rotation lying in a tool spindle plane, which plane is normal to the axle, in any adjustment position of the swivel arm and rocker arm, a workpiece spindle for supporting a workpiece to be machined by the machine tool and being arranged at the frame such that the machine tool and workpiece are locatable in the plane of the axis of rotation of the tool spindle, and a pair of clamping devices for retaining the swivel arm and rocker arm in any such adjustment position, said clamping devices being substantially identical and symmetrically disposed relative to the axis of rotation of the tool spindle so as to be substantially mirror images of one another, each clamping device having two cooperating members which are clampingly embraceable by frictional engagement with one another, one such member being mounted on the swivel arm and the other such member being mounted on the rocker arm, and wherein at least one of the two cooperating members of each clamping device is adjustable relative to the other corresponding member and is securable in a selective adjusted clamping position, and wherein one of the cooperating members includes a tension block adjustably mounted on a corresponding supporting portion of the swivel arm and which has a clamping cup for exerting a tensional force located in such tension block, and the other of the cooperating members includes a clamping rail located on a corresponding lateral side of the rocker arm which cooperates with the clamping cup, the clamping rail being clampingly embraced relative to the tension block by the tensional force exerted by the clamping cup.

4. Apparatus according to claim 3 wherein spring means capable of exerting a tensional spring force are provided for clampingly embracing the clamping rail by the clamping cup, and counteracting pressure release means are provided for counteracting the spring force to release the clamping embracing of the clamping rail by the clamping cup.

5. Apparatus according to claim 4 wherein the counteracting pressure release means includes pressure fluid means.

6. Apparatus according to claim 4 wherein the tension block includes a pressure cylinder and the clamping cup includes a thrust piston biased by at least one tension spring force exerting plate spring and having a thrust surface protruding from an end of the pressure cylinder for clampingly embracing the clamping rail thereat, the thrust piston being actuatable by the pressure release means so as to counteract the biasing spring force of the plate spring.

7. Apparatus according to claim 6 wherein the counteracting pressure release means includes pressure fluid means in the pressure cylinder for actuating the thrust piston.

8. Apparatus according to claim 3 wherein the clamping rails are made of a resilient metal.

9. Apparatus according to claim 8 wherein the resilient metal is spring steel.

10. Apparatus according to claim 1 wherein the tool spindle is provided with a machine tool in the form of a cup wheel.

11. Clampable apparatus operable at a heated operating temperature for producing convex and/or concave spherical surfaces in workpieces such as optical lenses, comprising a frame, a swivel arm adjustably mounted on the frame for movement to a selective adjustment position relative to the frame, a rocker arm adjustably mounted on the swivel arm for movement about a rocker pivot axis to a selective adjustment position relative to the swivel arm, a tool spindle for carrying a machine tool to machine a workpiece, and which is mounted on the rocker arm for axial displacement relative thereto and for rotation about a tool spindle axis of rotation lying in a tool spindle plane which is normal to the rocker pivot axis, a workpiece spindle for supporting a workpiece to be machined by the machine tool, and which is arranged at the frame in the tool spindle plane, means for maintaining the tool spindle axis of rotation in the tool spindle plane in any selective adjustment position of the swivel arm and of the rocker arm and in turn of the tool spindle, and bilateral clamping means on opposed sides of the tool spindle plane for releasably retaining the swivel arm and rocker arm in any selective adjustment position relative to each other, and including a pair of correspondingly opposed clamping devices substantially symmetrically disposed relative to the axis of rotation of the tool spindle, each clamping device having two cooperating members which are clampingly embraceable by operative engagement with one another, one such member being correspondingly mounted on the swivel arm and the other such member being correspondingly mounted on the rocker arm, one of the members of each clamping device being arranged for operative displacement to a heated operating temperature displacement location relative to the arm on which it is mounted, when the apparatus is at its corresponding heated operating temperature, for operative engagement at such displacement location with the other member of such clamping device, whereby to prevent lalteral deviation of the rocker arm and inturn of the tool spindle axis of rotation from the tool spindle plane.

12. Apparatus according to claim 11 wherein the clamping devices are substantially identical and are symmetrically disposed so as to be substantially mirror images of one another.

13. Apparatus according to claim 11 wherein at least one of the two cooperating members of each clamping device is selectively independently adjustable relative to the arm on which it is mounted and to the other corresponding member and is securable in a selective independently adjusted clamping position for operative engagement at such position with the other corresponding member.

14. Clampable apparatus for producing convex and/or concave spherical surfaces in workpieces such as optical lenses, comprising a frame, a swivel arm adjustably mounted on the frame for movement to a selective adjustment position relative to the frame, a rocker arm adjustably mounted on the swivel arm for movement about a rocker pivot axis to a selective adjustment position relative to the swivel arm, a tool spindle for carrying a machine tool to machine a workpiece, and which is mounted on the rocker arm for axial displacement relative thereto and for rotation about a tool spindle axis of rotation lying in a tool spindle plane which is normal to the rocker pivot axis, a workpiece spindle for supporting a workpiece to be machined by the machine tool, and which is arranged at the frame in the tool spindle plane, means for maintaining the tool spindle axis of rotation in the tool spindle plane in any selective adjustment position of the swivel arm and of the rocker arm and in turn of the tool spindle, and bilateral clamping means on opposed sides of the tool spindle plane for releasably retaining the swivel arm and rocker arm in any selective adjustment position relative to each other, and including a pair of correspondingly opposed clamping devices substantially symmetrically disposed relative to the axis of rotation of the tool spindle, each clamping device having two cooperating members which are clampingly embraceable by operative engagement with one another, one such member being correspondingly mounted on the swivel arm and the other such member being correspondingly mounted on the rocker arm, and wherein at least one of the two cooperating members of each clamping device is adjustable relative to the other corresponding member and is securable in a selective adjusted clamping position, and wherein one of the cooperating members includes a tension block adjustably mounted on a corresponding supporting portion of the swivel arm and which has a clamping cup for exerting a tensional force located in such tension block, and the other of the cooperating members includes a clamping rail located on a corresponding lateral side of the rocker arm which cooperates with the clamping cup, the clamping rail being clampingly frictionally embraced relative to the tension block by the tensional force exerted by the clamping cup, whereby to prevent lateral deviation of the rocker arm and in turn of the tool spindle axis of rotation from the tool spindle plane.

15. Apparatus according to claim 14 wherein spring means capable of exerting a tensional spring force are provided for clampingly embracing the clamping rail by the clamping cup, and counteracting pressure release means are provided for counteracting the spring force to release the clamping embracing of the clamping rail by the clamping cup.

16. Apparatus according to claim 15 wherein the tension block includes a pressure cylinder and the clamping cup includes a thrust piston biased by at least one tension spring force exerting plate spring and which has a thrust surface operatively protruding from the pressure cylinder for clampingly embracing the clamping rail thereat, and wherein the pressure release means includes pressure fluid means in the pressure cylinder, the thrust piston being actuatable by the pressure fluid means for counteracting the biasing spring force of the plate spring.

17. Apparatus according to claim 14 wherein the clamping rails are made of a resilient metal.

* * * * *